US008049696B2

(12) United States Patent
Wang

(10) Patent No.: US 8,049,696 B2
(45) Date of Patent: Nov. 1, 2011

(54) STANDBY CIRCUIT AND METHOD FOR A DISPLAY DEVICE

(75) Inventor: Hui-Min Wang, Tainan (TW)

(73) Assignee: Himax Media Solutions, Inc., Tainan County (TW)

( * ) Notice: Subject to any disclaimer, the term of this patent is extended or adjusted under 35 U.S.C. 154(b) by 569 days.

(21) Appl. No.: 12/326,855

(22) Filed: Dec. 2, 2008

(65) Prior Publication Data

US 2010/0134391 A1 Jun. 3, 2010

(51) Int. Cl.
*G09G 3/36* (2006.01)

(52) U.S. Cl. ..... 345/87; 345/204; 345/100; 345/84; 345/178

(58) Field of Classification Search ..... 345/87, 345/178, 204, 100, 84
See application file for complete search history.

(56) References Cited

U.S. PATENT DOCUMENTS

| | | | | |
|---|---|---|---|---|
| 4,995,058 | A * | 2/1991 | Byers et al. | 340/855.5 |
| 5,425,004 | A * | 6/1995 | Staffan | 368/46 |
| 6,407,732 | B1 * | 6/2002 | Stiens et al. | 345/204 |
| 6,954,868 | B2 * | 10/2005 | Lin et al. | 713/324 |
| 2002/0091952 | A1 * | 7/2002 | Lin et al. | 713/300 |
| 2002/0122030 | A1 * | 9/2002 | Stiens et al. | 345/178 |
| 2002/0196223 | A1 * | 12/2002 | Takahashi et al. | 345/90 |

* cited by examiner

*Primary Examiner* — Van Chow
(74) *Attorney, Agent, or Firm* — Stout, Uxa, Buyan & Mullins, LLP

(57) ABSTRACT

A standby circuit and method for a display device is disclosed. A detector detects voltage drop of the first termination resistor of a positive path of a clock channel, and the second termination resistors of a negative path. Upon detecting the voltage drop, a switch controller disconnects the positive path or the negative path that has the detected voltage drop, thereby saving power in the standby mode of the display device.

15 Claims, 6 Drawing Sheets

STANDBY CIRCUIT AND METHOD FOR A DISPLAY DEVICE

BACKGROUND OF THE INVENTION

1. Field of the Invention

The present invention generally relates to power management, and more particularly to a low power standby circuit and method for a LCD computer display.

2. Description of the Prior Art

The Digital Visual Interface (DVI) is a video interface standard developed, by the Digital Display Working Group (DDWG), to enhance the visual performance of digital display devices such as liquid crystal display (LCD) computer displays. According to the DVI standard, the brightness of associated pixels is transmitted as uncompressed binary data stream to the display.

The High-Definition Multimedia Interface (HDMI) is another, but recently adopted, video interface standard developed also to transmit uncompressed digital data stream to the display devices such as LCD computer displays and digital televisions. As the DVI signal is electrically compatible with HDMI video signal, the HDMI is backward compatible with the DVI.

The growing demands for portable or battery-powered electronic devices call for longer operating time. The battery power, however, could not keep up with pressing need of longer operating time for the modern electronic devices. Reducing power consumption is thus becoming an alternative and more feasible way to reach that object. For a next-generation or a proprietary power saving protocol, the maximum power consumption of the LCD monitor control integrated circuit (IC) of the display device shall conform to being as low as, for example, 0.5 W in the standby mode. According to that protocol, the display controller in the display device is allocated maximum 20 mA of current. However, a substantive portion, for example, half of the allocated 20 mA is usually wastefully drawn.

For the reason that conventional display controller could not effectively save further power to conform to modern power saving protocol, a need has arisen to propose a low power standby mechanism for substantially saving power consumption.

SUMMARY OF THE INVENTION

In view of the foregoing, it is an object of the present invention to provide a low power standby circuit and method for saving power in the standby mode of a display controller and its display device.

According to one embodiment, a detector detects voltage drop of the first termination resistor of a positive path of a clock channel, and the second termination resistors of a negative path. Upon detecting the voltage drop, a switch controller controls the positive switch of the positive path and the negative switch of the negative path according to an output of the detector, such that the positive switch or the negative switch that has the detected voltage drop is open by the switch controller, thereby saving power in the standby mode of the display device.

DETAILED DESCRIPTION OF THE INVENTION

Figure 1:
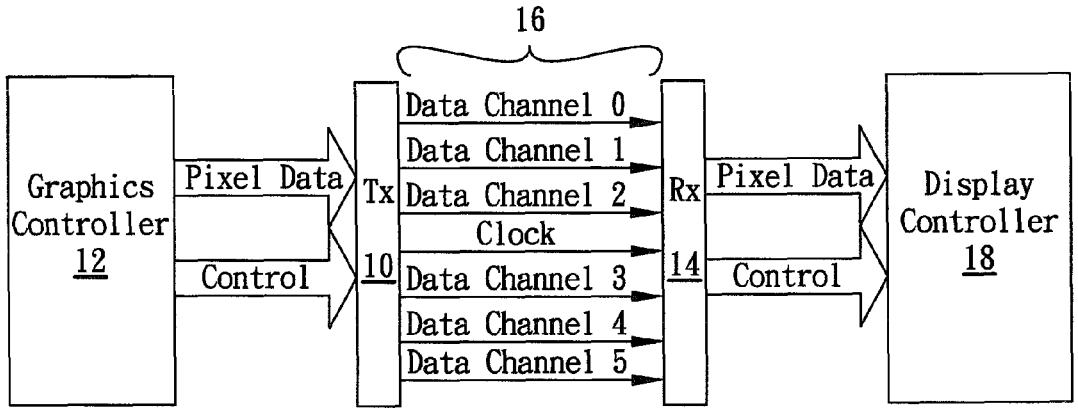
FIG. 1 illustrates the architecture of the Digital Visual Interface (DVI)

FIG. 1 illustrates the architecture of the Digital Visual Interface (DVI). Although the DVI standard is illustrated here, it is appreciated that other (either past or future) video standards can be well adapted to the present invention. The DVI architecture shown in FIG. 1 includes a transmitter (Tx) 10 that receives and sends pixel data/control signals originated from a graphics controller 12 to a receiver (Rx) 14, via a link 16. In the figure, the link 16 consists of, but is not limited to, six data/control channels (Channels 0 through 5) and one clock channel. The pixel data/control signals retrieved from the receiver (Rx) 14 are then forwarded to a display controller (e.g., an LCD monitor control integrated circuit or IC) 18 of a display device such as a liquid crystal display (LCD) computer display. In the present invention, the display device is preferably embodied in, but not limited to, portable or battery-powered electronic devices that have limited power. According to the DVI standard, the pixel data are transported using the transition minimized differential signaling (TMDS) format, which converts 8 bits of data into a 10-bit TMDS signal. Each channel is implemented by a twisted pair of wire for carrying the data, the control signals or the clock signals.

Figure 2:
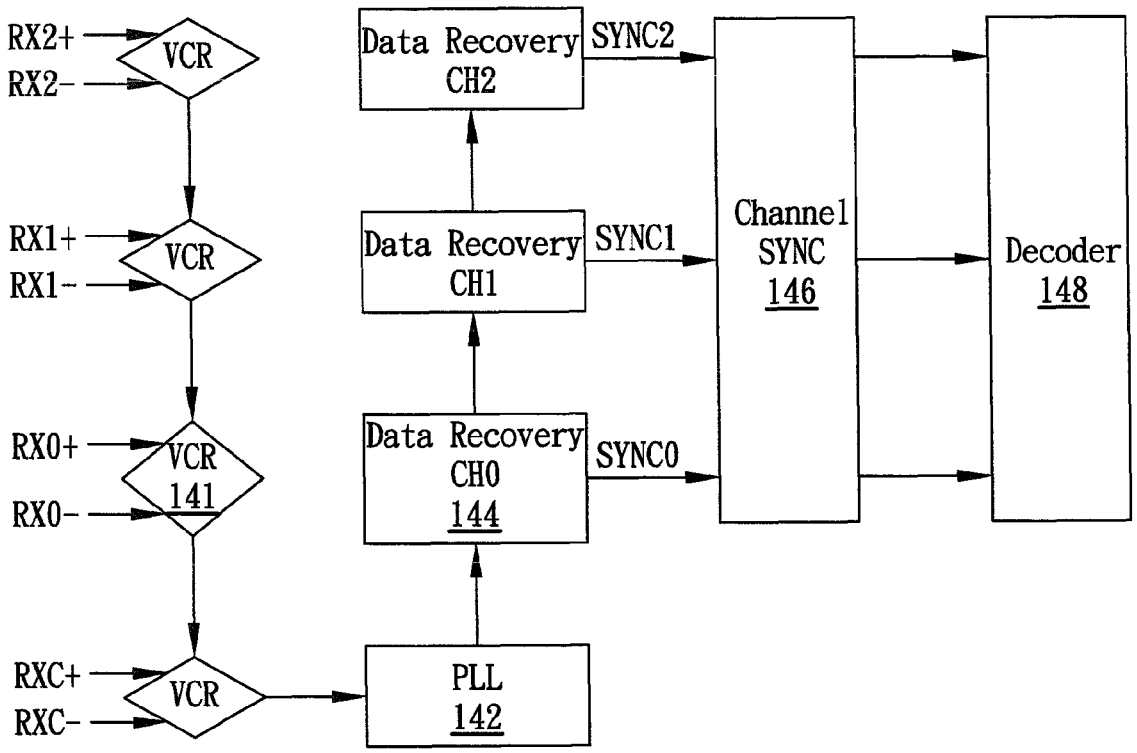
FIG. 2 illustrates a detailed functional block diagram of the receiver (Rx) in FIG. 1.

FIG. 2 illustrates a detailed functional block diagram of the receiver (Rx) 14 in FIG. 1. In the figure, there are shown three data channels CH0, CH1 and CH2 (i.e., RX0−/RX0+, RX1−/RX1+ and RX2−/RX2+) and one clock channel (RXC−/RXC+). Voltage-controlled resistors (VCRs) 141 are resistors, the resistance (for example, about 50Ω) of which can be controllably maintained. A phase lock loop (PLL) 142 generates locked clock signals according to the received clock signals. The locked clock signals are then used respectively (by blocks 144) to recover the data of each channel, such that the data signals are properly phased locked. Subsequently, the data streams from the blocks 144 are synchronized (in block 146), for example, according to synchronization signals (SYNC) during a blanking period. Finally, the data streams are decoded by a decoder 148, such that the 10-bit TMDS signals are converted back to 8-bit data suitable for displaying in the display device. It is noted that, in some embodiments of the present invention, some or all of the blocks shown in the figure can be shut down or closed in the standby mode to save power consumption.

Figure 3A:
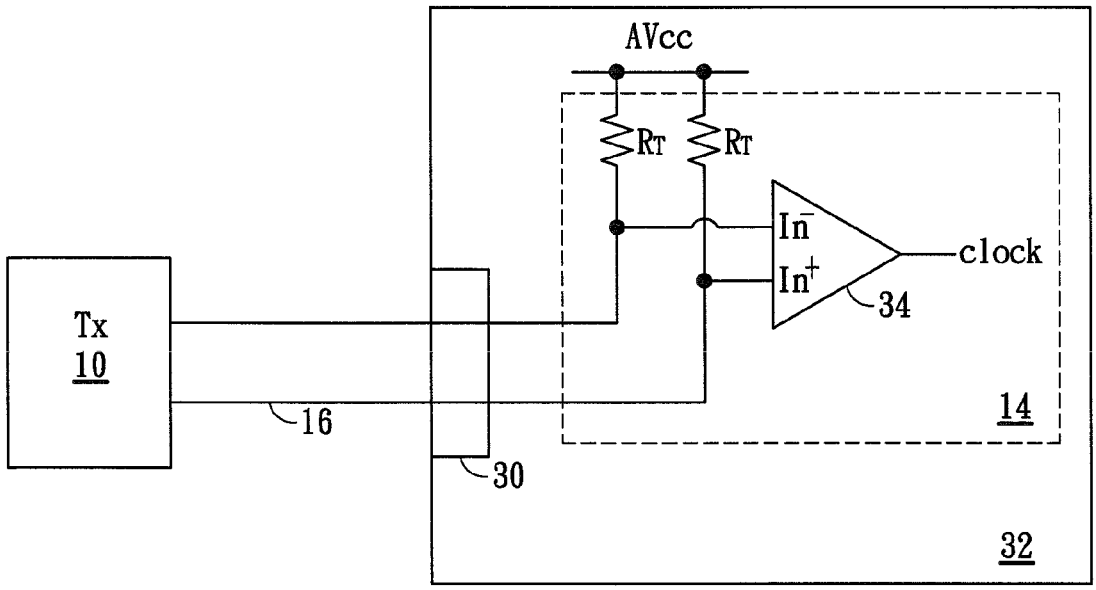
FIG. 3A shows a schematic of the TMDS differential pair at the receiver (Rx)

FIG. 3A shows a schematic of the TMDS differential pair, particularly the clock pair, at the receiver (Rx) 14. The transmitter (Tx) 10 sends differential signals to the receiver (Rx) 14 via a receptacle 30. The receptacle 30 and the receiver (Rx) 14 are usually located on a printed circuit board 32. The reference (or supply) voltage AVcc sets the high voltage of the differential signals. The termination resistance $R_T$, such as the VCR 141 in FIG. 2) at the receiver (Rx) 14 is used to match the characteristic impedance of the twisted pair of the link 16. The differential signals are inputted to a differential amplifier 34, which generally acts as a clock sensing amplifier or operational (OP) amplifier. When the transmitter (Tx) 10 is at the active mode, the transmitter (Tx) 10 sends clock signal across the RXC+ and RXC− of the receiver (Rx) 14, and the voltage at the positive node (In+) or the negative node (In−) thus has periodic change from high voltage (e.g., 3.3V) to low voltage (e.g., 0V).

Figure 3B:
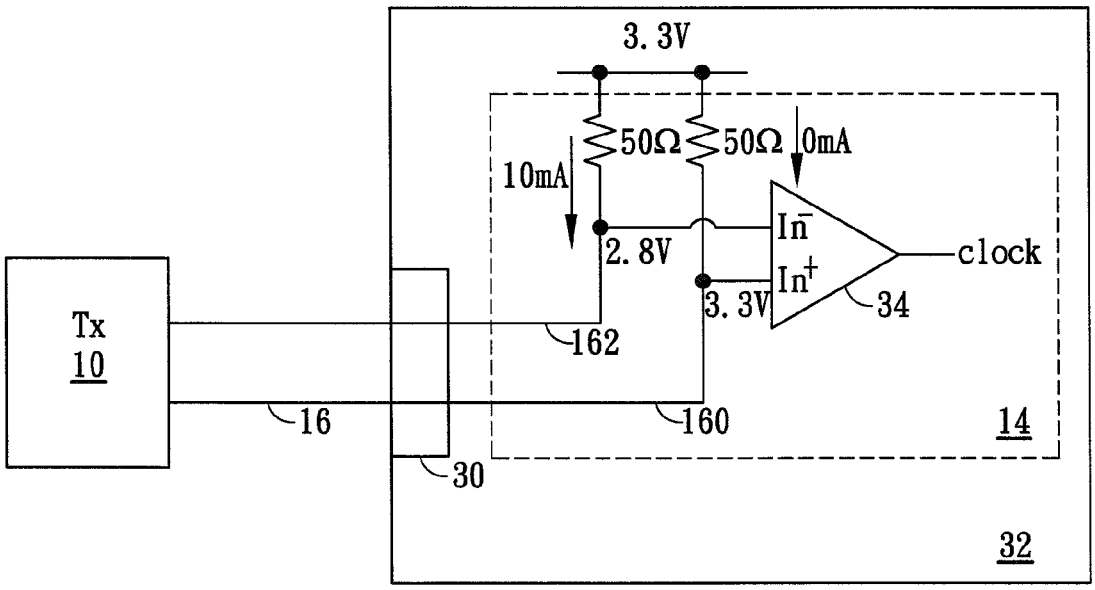
FIG. 3B shows an exemplary schematic of the clock pair at the receiver (Rx) when the display device is in the standby mode (i.e., TXC+=0 mA, TXC−=10 mA)

FIG. 3B shows an exemplary schematic of the clock pair at the receiver (Rx) 14 when the display device is in the standby mode. During the standby mode, in this exemplary figure, the voltage at the positive (or non-inverting) node (In+) is 3.3V, and thus no current is drawn through the path 160; the voltage at the negative (or inverting) node (In−) is 2.8V, and thus 10 mA of current is drawn to the transmitter (Tx) 10 through another path 162. That is, TXC+=0 mA, TXC−=10 mA. Accordingly, the display device still consumes power even in the standby mode, during which no clock signal is sent. This becomes critical for a display device conforming to a power saving protocol that demands, for example, a maximum 0.5 W of power consumption in the standby mode. According to that protocol, the display controller 18 (FIG. 1) is allocated maximum 20 mA of current. That is, half of the allocated 20 mA is wastefully drawn out of the receiver (Rx) 14.

Figure 3C:
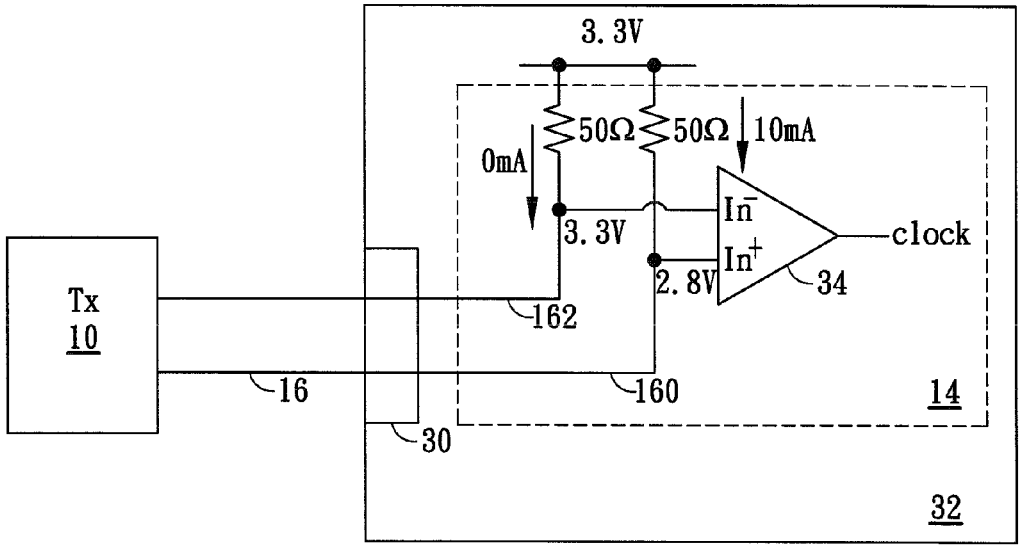
FIG. 3C shows another exemplary schematic of the clock pair at the receiver (Rx) when the display device is in the standby mode (i.e., TXC+=10 mA, TXC−=0 mA)

FIG. 3C shows another exemplary schematic of the clock pair at the receiver (Rx) 14 when the display device is in the standby mode. During the standby mode, in this exemplary figure, the voltage at the positive (or non-inverting) node (In+) is 2.8V, and thus 10 mA of current is drawn to the transmitter (Tx) 10 through the path 160; the voltage at the negative (or inverting) node (In−) is 3.3V, and thus no current is drawn through the other path 162. That is, TXC+=10 mA, TXC−=0 mA. Compared to the example of FIG. 3B, the 10 mA of current in FIG. 3C is drawn through the path 160 rather than the path 162 as in FIG. 3B. However, currents are wastefully drawn out of the circuit either in FIG. 3C or FIG. 3B.

Figure 3D:
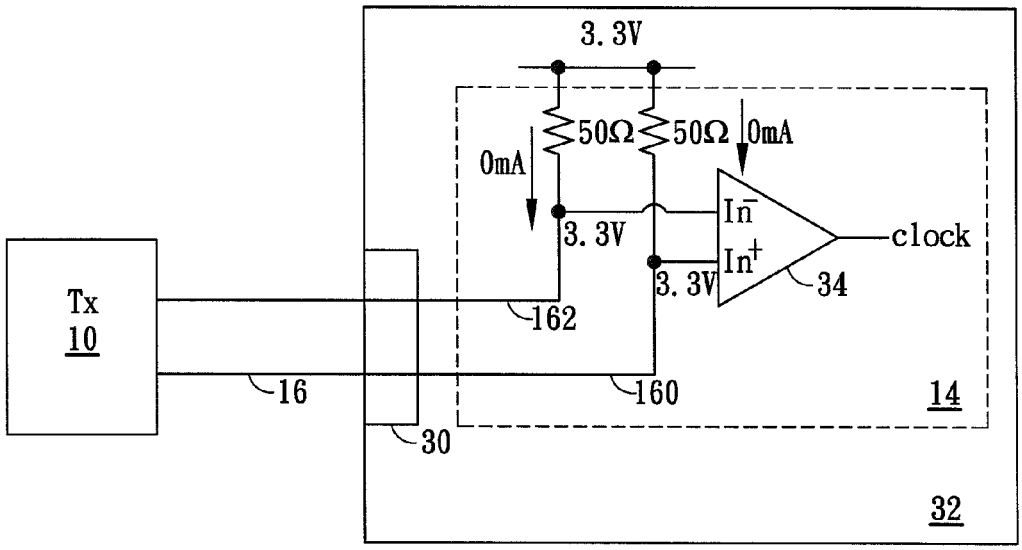
FIG. 3D shows a further exemplary schematic of the clock pair at the receiver (Rx) when the display device is in the standby mode (i.e., TXC+=0 mA, TXC−=0 mA)

FIG. 3D shows a further exemplary schematic of the clock pair at the receiver (Rx) when the display device is in the standby mode. During the standby mode, in this exemplary figure, the voltage at the positive (or non-inverting) node (In+) is 3.3V, and thus no current is drawn to the transmitter (Tx) 10 through the path 160; the voltage at the negative (or inverting) node (In−) is also 3.3V, and thus no current is drawn through the other path 162. That is, TXC+=0 mA, TXC−=0 mA. Compared to the examples of FIG. 3B and FIG. 3C, no current is drawn through the path 160 and the path 162 in FIG. 3D.

The three cases of the standby mode as exemplified in FIG. 3B through FIG. 3D are summarized in the following Table 1.

TABLE 1

| | Standby mode | | | |
|---|---|---|---|---|
| | In+ | In− | RXC+ | RXC− |
| Case (1) (FIG. 3B) | 3.3 V | 2.8 V | 0 mA | 10 mA |
| Case (2) (FIG. 3C) | 2.8 V | 3.3 V | 10 mA | 0 mA |
| Case (3) (FIG. 3D) | 3.3 V | 3.3 V | 0 mA | 0 mA |

Figure 4:
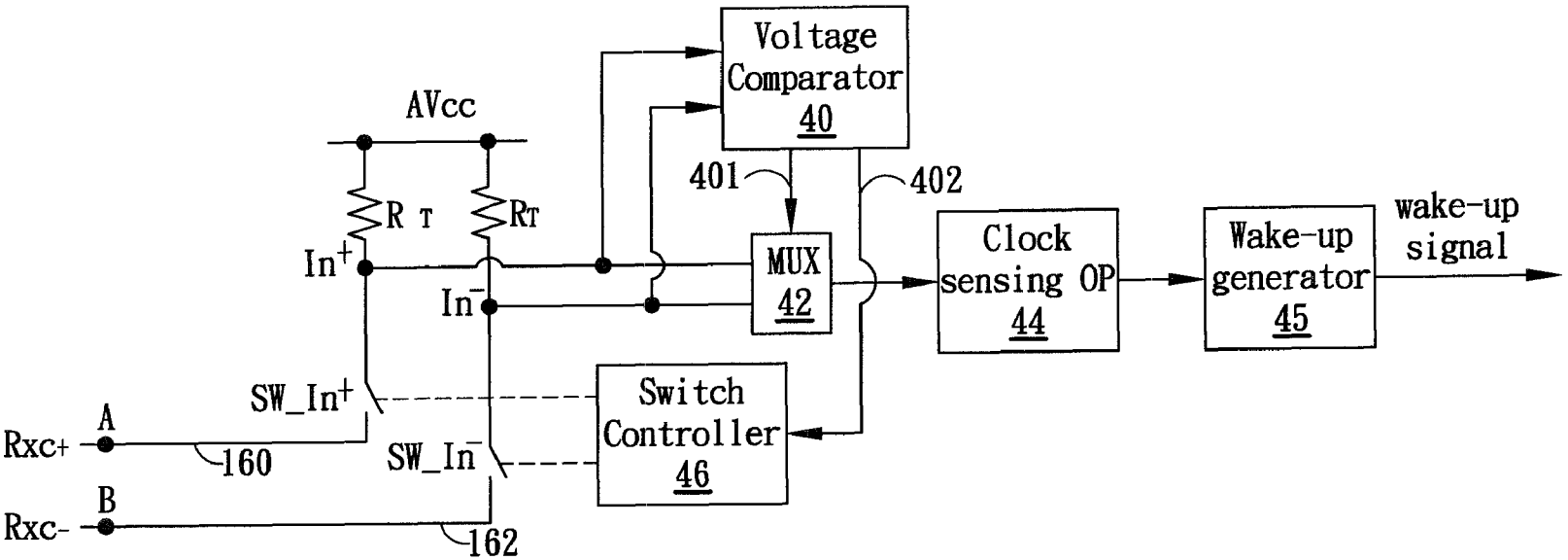
FIG. 4 illustrates a low power standby circuit according to one embodiment of the present invention.
Figure 5:
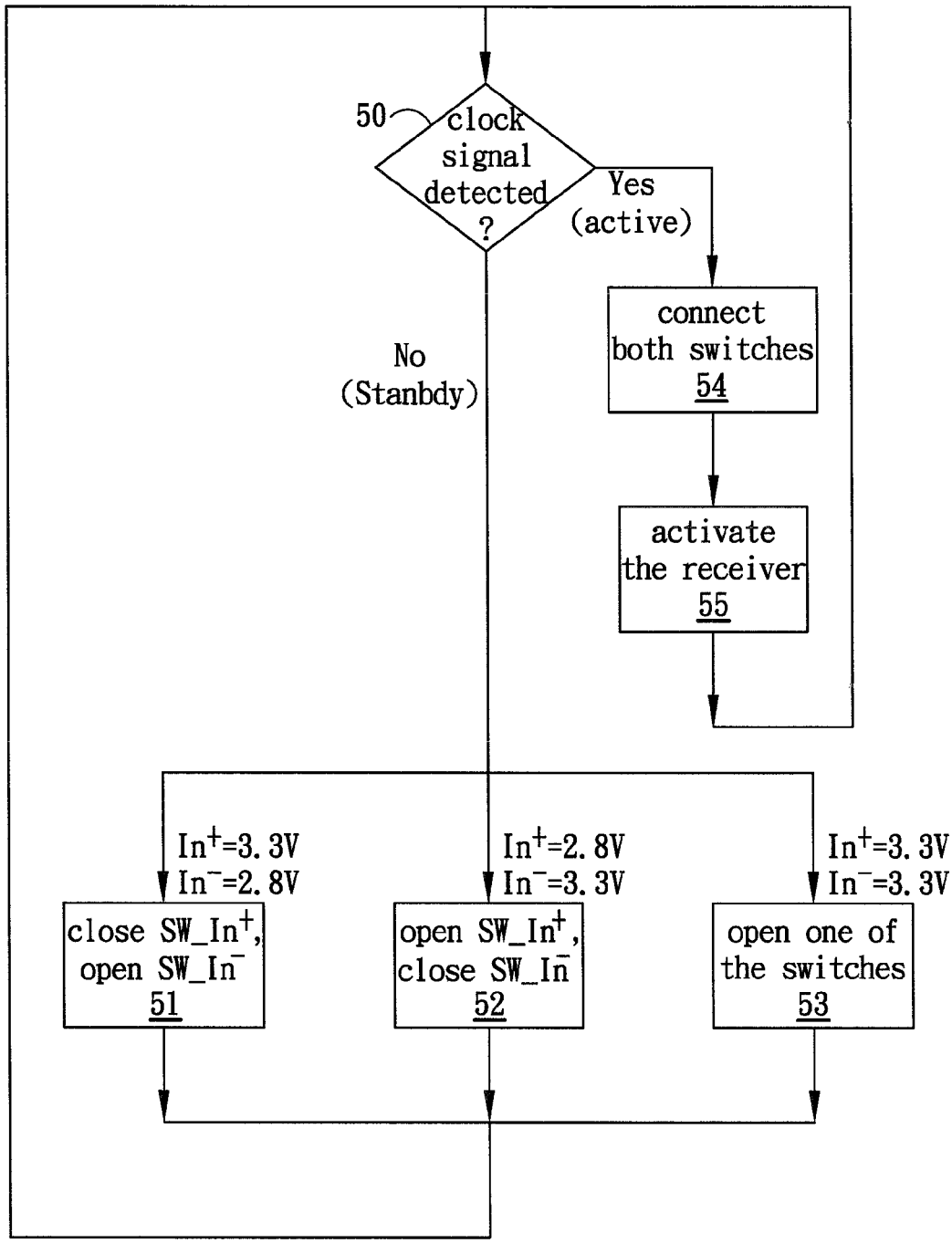
FIG. 5 shows a flow diagram illustrating a low power standby method according to the embodiment of the present invention.

FIG. 4 illustrates a low power standby circuit according to one embodiment of the present invention, and FIG. 5 shows a flow diagram illustrating a low power standby method according to the embodiment of the present invention. As discussed above, when the transmitter (Tx) 10 is at the active mode, the transmitter (Tx) 10 sends clock signal across the RXC+ and RXC− of the receiver (Rx) 14, and the voltage at the positive node (In+) or the negative node (In−) thus has periodic change from high voltage (e.g., 3.3V) to low voltage (e.g., 0V). The periodic change of clock signal is detected (step 50) by a detector, such as a voltage comparator 40 based on the voltage at the positive node (In+) and the voltage at the negative node (In−). In another embodiment, however, the voltage comparator 40 may perform detection based on the voltage at the nodes A and B instead. The output 401 of the detector 40 is used to control a multiplexer (MUX) 42 to let either the voltage at the positive node (In+) or the voltage at the negative node (In−) pass to a clock sensing amplifier or operational (OP) amplifier 44, for example, the differential amplifier 34 in FIG. 3A. The output of the clock sensing OP 44 may be further inputted to a wake-up generator 45 that outputs a wake-up signal when the clock signal is detected.

When the transmitter (Tx) enters into the inactive mode, the transmitter (Tx) 10 no longer sends clock signal across the RXC+ and RXC− of the receiver (Rx) 14, and thus no periodic change is detected (step 50), by the detector 40, at the positive node (In+) or the negative node (In−), indicating the standby mode. The three cases of standby mode are respectively discussed as follows.

Case (1)

As the detector 40 detects that the voltage at the positive node (In+) maintains at about 3.3V and the voltage at the negative node (In−) maintains at about 2.8V, one output 402 of the detector 40 control a switch controller 46 to close (or connect) a (first) switch SW_In+ and open (or disconnect) a (second) switch SW_In− (step 51). It is appreciated that the output 401 and the output 402 may be the same or distinct signals. In the embodiment, the switch controller 46 may be implemented by a multiplexer (MUX). Accordingly, the 10 mA of current drawn to the transmitter (Tx) 10 through the path 162 is thus eliminated, thereby substantially saving the power consumption. As a result, the detector 40 can detect the activeness of the transmitter (Tx) 10 via the path 160, and the signal at the positive node (in+) is forwarded through the MUX 42 to the clock sensing OP 44.

Case (2)

As the detector 40 detects that the voltage at the positive node (In+) maintains at about 2.8V and the voltage at the negative node (In−) maintains at about 3.3V, the output 402 of the detector 40 control the switch controller 46 to open (or disconnect) the (first) switch SW_In+ and close (or connect) the (second) switch SW_In− (step 52). Accordingly, the 10 mA of current drawn to the transmitter (Tx) 10 through the path 160 is thus eliminated, thereby substantially saving the power consumption. As a result, the detector 40 can detect the activeness of the transmitter (Tx) 10 via the path 162, and the signal at the negative node (in−) is forwarded through the MUX 42 to the clock sensing OP 44.

Case (3)

As the detector 40 detects that the voltage at both the positive node (In+) and the negative node (in−) maintains at about 3.3V, the output 402 of the detector 40 control the switch controller 46 to open (or disconnect) one of the switches Sw_In+/SW_In− while close (or connect) the other switch (step 53). As a result, the detector 40 can detect the activeness of the transmitter (Tx) 10 via one of the paths 160/162, and the signal at the positive node (in+) or the negative node (In−) is forwarded through the MUX 42 to the clock sensing OP 44.

The switch SW_In− or the switch SW_In+ will remain open until periodic change is detected at the positive node (In+) or the negative node (In−), indicating the active mode of the transmitter (Tx) 10. At this time, the detector 40 controls the switch controller 46 to close both the switches Sw_In+/SW_In− (step 54), and a wake-up signal is also generated by the wake-up generator 45 to activate the receiver (Rx) 14 (step 55).

According to the embodiment, in the standby mode, one clock path of the twist pair of wire is disconnected, thereby substantially saving the power consumption; while the other clock path is still being sensed to determine the presence or absence of the clock signal. Upon detecting the presence of the clock signal, the disconnected path is then restored.

Although specific embodiments have been illustrated and described, it will be appreciated by those skilled in the art that various modifications may be made without departing from the scope of the present invention, which is intended to be limited solely by the appended claims.

What is claimed is:

1. A standby circuit for a display device, comprising:

a positive switch connected between a first termination resistor and a positive path of a clock channel;

a negative switch connected between a second termination resistor and a negative path of the clock channel;

a detector that detects voltage drop of the first and the second termination resistors; and a switch controller that controls the positive and the negative switches according to an output of the detector, such that the positive switch or the negative switch that has the detected voltage drop is open by the switch controller, thereby saving power at a standby mode of the display device.

2. The standby circuit of claim 1, further comprising a multiplexer that passes one of the signals of the positive path and the negative path therethrough according to the output of the detector.

3. The standby circuit of claim 2, further comprising a clock sensing amplifier that receives an output of the multiplexer.

4. The standby circuit of claim 3, further comprising a wake-up generator that generates a wake-up signal when the clock sensing amplifier senses a clock signal.

5. The standby circuit of claim 1, wherein the detector includes a voltage comparator.

6. The standby circuit of claim 5, wherein the voltage comparator is a differential amplifier.

7. The standby circuit of claim 1, wherein the switch controller includes a multiplexer.

8. The standby circuit of claim 1, wherein the standby circuit conforms to Digital Visual Interface (DVI) specification or High-Definition Multimedia Interface (HDMI) specification.

9. A standby method for a display device, comprising:

detecting voltage drop of a first termination resistor of an associated positive path of a clock channel, and a second termination resistor of an associated negative path of the clock channel; and disconnecting the positive path or the negative path, the associated first or the second termination resistor of which has the detected voltage drop, thereby saving power at a standby mode of the display device.

10. The standby method of claim 9, further comprising a step of multiplexing one of the signals of the positive path and the negative path therethrough according to detected result.

11. The standby method of claim 10, further comprising a step of sensing clock signal of the multiplexed signal.

12. The standby method of claim 11, further comprising a step of generating a wake-up signal when the clock signal is sensed.

13. The standby method of claim 11, further comprising a step of connecting both of the positive path and the negative path when the clock signal is sensed.

14. The standby method of claim 9, wherein the detecting step includes comparing the voltage drop of the first and the second termination resistors.

15. The standby method of claim 9, wherein the standby method conforms to Digital Visual Interface (DVI) specification or High-Definition Multimedia Interface (HDMI) specification.

* * * * *